US007116282B2

(12) United States Patent
Trankina

(10) Patent No.: US 7,116,282 B2
(45) Date of Patent: Oct. 3, 2006

(54) TOWER REINFORCEMENT

(76) Inventor: John Trankina, 30W710 Smith Rd., Wayne, IL (US) 60184

( * ) Notice: Subject to any disclaimer, the term of this patent is extended or adjusted under 35 U.S.C. 154(b) by 90 days.

(21) Appl. No.: 10/684,645

(22) Filed: Oct. 14, 2003

(65) Prior Publication Data

US 2005/0078049 A1 Apr. 14, 2005

(51) Int. Cl.
*H01Q 9/34* (2006.01)
*E04B 1/18* (2006.01)

(52) U.S. Cl. ..... 343/890; 343/891; 52/633; 52/651.01; 52/98; 52/727

(58) Field of Classification Search ..... 343/874, 343/872, 890–891; 52/741.1, 745.21, 736.3, 52/737.5, 648, 731, 738.1, 723.1, 736.1, 52/726.4, 633, 730, 98, 28, 651.01, 272, 52/722

See application file for complete search history.

(56) References Cited

U.S. PATENT DOCUMENTS

| | | | | | |
|---|---|---|---|---|---|
| 1,959,756 | A * | 5/1934 | Ferm | 138/157 |
| 3,013,584 | A * | 12/1961 | Reed et al. | 138/145 |
| 3,987,593 | A * | 10/1976 | Svensson | 52/98 |
| 4,248,025 | A | 2/1981 | Kleine et al. | 126/518 |
| 4,377,812 | A * | 3/1983 | Gobel et al. | 343/872 |
| 4,751,804 | A * | 6/1988 | Cazaly | 52/721.2 |
| 4,934,114 | A | 6/1990 | Lindsey | 52/40 |
| 5,017,938 | A | 5/1991 | Dienes | 343/874 |
| 5,097,647 | A * | 3/1992 | Sopik et al. | 52/651.07 |
| 5,101,215 | A * | 3/1992 | Creaser, Jr. | 343/883 |
| 5,375,353 | A * | 12/1994 | Hulse | 40/217 |
| 5,880,701 | A * | 3/1999 | Bhame et al. | 343/890 |
| 5,904,004 | A | 5/1999 | Hill | 52/40 |
| 5,941,036 | A | 8/1999 | Hill | 52/292 |
| 5,999,145 | A | 12/1999 | Niekamp | 343/890 |
| 6,057,804 | A | 5/2000 | Kaegebein | 343/792 |
| 6,131,349 | A | 10/2000 | Hill | 52/292 |
| 6,173,537 | B1 | 1/2001 | Davidsson et al. | 52/40 |
| 6,286,281 | B1 | 9/2001 | Johnson | 52/592.1 |
| 6,513,299 | B1 * | 2/2003 | Damiano | 52/651.02 |
| 6,694,698 | B1 * | 2/2004 | Ryan | 52/741.1 |
| 6,851,231 | B1 * | 2/2005 | Tadros et al. | 52/223.4 |
| 6,901,717 | B1 * | 6/2005 | Brunozzi et al. | 52/723.1 |
| 6,915,618 | B1 * | 7/2005 | Payne | 52/736.1 |
| 2002/0140621 | A1 * | 10/2002 | Harrison | 343/890 |
| 2005/0129504 | A1 * | 6/2005 | De Roest | 415/4.2 |
| 2005/0166521 | A1 * | 8/2005 | Silber | 52/633 |

* cited by examiner

*Primary Examiner*—Hoang V. Nguyen
*Assistant Examiner*—Chuc Tran
(74) *Attorney, Agent, or Firm*—Levenfeld Pearlstein, LLC.

(57) ABSTRACT

A device and method of reinforcement for towers, such as those used for electrical communications and telephonic devices, is provided. Elongated stiffening members are provided for indirect attachment to a tower by means of spacer elements. The spacer elements, which are structurally connected to the tower, provide a location for attachment of the stiffening members such that the tower is reinforced while minimizing any damage to the actual tower through the attachment of reinforcement. In one embodiment an external structural support shell, fastened concentrically about a tower, is also provided. The support shell forms an exterior wall, spaced apart from the antenna tower and fastened thereto with structural elements, such that the antenna tower is strengthened. The placing of the support shell about the tower has the added benefit of creating a space for feeding electrical and communication cables such that communication devices may be added to an existing tower without having cables showing on the exterior surface of the tower.

15 Claims, 5 Drawing Sheets

FIG. 4

TOWER REINFORCEMENT

BACKGROUND OF THE INVENTION

The present invention concerns a device and method for stiffening tall thin tower structures. More particularly, the present invention concerns a device and method for stiffening long, tapered, antenna towers.

Because of the number of telephones, fax machines, cellular phones, and other communication devices currently used, the need for more, stronger and even taller, antenna towers has become prevalent throughout the country. As a result, long, slender antenna towers are appearing nationwide. Typically, these towers are thin, tubular structures, which start out with a large diameter base and taper down to a thinner cross-section. The towers are usually bedecked with a number of devices such as microwave relay stations, cellular telephone cells, satellite dishes and other types of communication hardware. Each such tower can be designed to hold a number of such devices, depending on its structural abilities.

Further, these types of antennas are often placed on top of tall structures such as buildings and/or in open fields, where they can receive and transmit signals without interference. As a result of isolated location placement, the towers are typically subjected to buffeting winds and other potentially damaging weather conditions.

Further, the towers which act somewhat like cantilevered beams (in that they are attached at one end, the ground, and are unattached at the top), are affected by the weight of the electronic equipment, and other equipment, placed near the top of the tower, such that a moment force acts on the tower. As a result, great forces are placed on the tower causing, often times, the tower to sway and/or have a pronounced bend or lean. This can make these towers unsightly, and give the impression of imminent collapse. In extreme wind or other conditions, these towers can receive such severe forces that they can collapse, causing extensive and expensive damage to communications devices, as well as the destruction of the antenna tower and disruptions in communications. Such collapses also pose dangers to persons and property in the vicinity of the tower at the time of the collapse.

It has been found, that the present design of a monopole tower, is one of the most popular as it presents a most appealing shape. Use of more heavily reinforced or structurally complex towers, including those made with lattice frames, such as high tension electrical towers, or having a variety of Guy wires attached, such as to the apex of a tower and then in a radius about the base of the tower, can be unsightly, more costly, undesirable and difficult to fit in a small space. It is, therefore, desirable to produce a monopole type tower, that can be structurally strengthened so that it can withstand the weight of several pieces of generally heavy communications equipment, at the tower's upper regions. It is desirable that such towers withstand wind and other natural forces that cause present and prior art towers to have the problems described above.

SUMMARY OF THE INVENTION

In accordance with the present invention, an antenna-tower reinforcement, for use with monopole antenna structures, is provided. The antenna tower reinforcement comprises high strength structural elements attachable to the antenna tower and a lightweight shell, having a cross-sectional shape similar to that of the antenna tower, attachable to the stiffening or structural elements.

In one embodiment three stiffening or structural elements are attached at generally equal distances about the circumference of the tower and the lightweight shell is then attached thereto. The lightweight shell, attached to the structural elements, can be formed so as to have an outward appearance similar to that of the antenna tower, such that when the tower is viewed, the antenna and shell combination appears to be the antenna tower alone.

In another preferred embodiment, three stiffening members, distributed evenly about the circumference of the tower, are provided and extend generally from near the base of the antenna tower to a desired point above the base. Spacer plates are placed, such as by welding them to the tower, such that the tower can be insulated from any damage in installing the stiffening members. In this embodiment, the stiffening members are elongated such that they span from near the base of the tower to a desired point well above the base. In order to provide such lengthy, elongated, stiffening members numerous structural elements may be joined together to form the entire length of the stiffening member. Such elongated stiffening members provide a rigid structure to assist in the support and stiffness of the tower.

Advantageously, the spacer elements provide an insulating space between the tower and the stiffening element during the process, typically welding, of connecting the stiffening member elements together. The spacer elements provide a smaller surface for attachment to the tower, potentially causing less damage to the tower than the attachment of lengthier structural elements directly thereto.

It will be understood by persons having skill in the art that fewer than three and more than three structural elements, in either example above, may be used without departing from the novel scope of the present invention. Further, the elements may be spaced in any manner that will produce desirable structural reinforcement of the tower, with out departing from the novel scope of the present invention.

In another preferred embodiment, an antenna tower and shell are made of similar materials, such as aluminum, steel, graphite, or composite mixes of metals, as is well known in the antenna art. The high strength stiffening members, in a preferred embodiment, can be any typical structural member such as I-bars, Z-bars, or members created by the combination of steel plates, plates and bars or the combination of any structural elements. In a current embodiment, the structural members are welded to the tower (i.e., using welded attachments). The structural members are attached to the shell using powder actuated fasteners, of a type known in the art, so as to make the connections easier and quicker to make. Alternately, the members can be welded to the shell. It will be understood by persons having skill in the art, that any reliable and desirable form of fastener, fastening device, or manner of affixing the structural member, antenna tower and shell together may be used without departing from the novel scope of the present invention.

In another embodiment of the present invention, a plurality of structural members, of smaller lengths, are attached at many points along the circumference of the tower. Each structural element provides an anchor point for a portion of the shell and provides localized stiffening at the points of attachment of the member to the antenna tower. Further stiffening, in the present embodiment, is provided by the attachment of the shell to all of the structural members.

In another embodiment of the present invention, a low profile reinforcement is added to the tower in the form of structural elements attached to the perimeter of the antenna tower, without an outer shell, such that the tower is stiffened and thereby strengthened. It will be understood by persons having skill in the art, that the structural members used without the shell should preferably of the more lengthy type, first described above, however, the structural elements can be of any of the types discussed above, with respect to the tower and shell embodiment of the present invention, or others, without departing from the novel scope of the present invention.

It will be understood by persons having skill in the art, that the shell structure, of some of the embodiments, can be made in sections, which can be attached together either at the site of the antenna or prior to the each shell segment's attachment to the antenna as is convenient and more easily accomplished. Persons having skill in the art will understand that other methods of creating, such as its creation as a unitary member placed concentrically about the antenna tower, and preparing the shell for attachment to the underlying antenna tower are possible and should not be considered a departure from the novel scope of the present invention.

In another preferred embodiment, the shell provides a location for the placement of electrical or communication cables, and other wires and devices from the transmission devices attached to the antenna to the base of the antenna, without having the cables wires and other members, being seen from the outside of the shell. In this manner, the antenna, using the device of the present invention, presents a more neat and orderly appearance. It will be understood by persons having skill in the art that a shell structure of this type is adaptable to each of the embodiments described herein with slight modification.

A more detailed explanation of the invention is provided in the following description and claims and is illustrated in the accompanying drawings.

DETAILED DESCRIPTION OF THE ILLUSTRATIVE EMBODIMENTS

Figure 1:
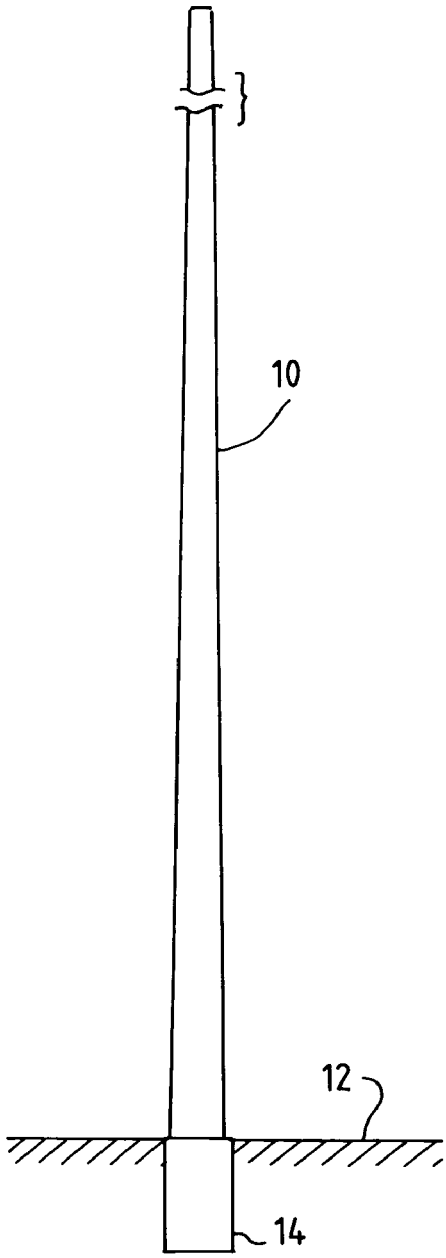
FIG. 1 is an elevational view of an antenna tower of the type used with the device of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring to the drawings, a monopole tower 10 of a type commonly used is shown. Tower 10 is comprised of a mast extending from a surface 12, such as the ground or the roof of a building, and an anchor portion 14 embedded within the surface. It will be understood by persons having skill in the art that monopole tower 10 may have any type of anchorage or foundation with out departing from the novel scope of the present invention. Further, it will be understood that antenna tower 10 may be constructed of any type of structural material, such as steel, aluminum, graphite, highbred material, cast metals, concrete, plastics, wood and other materials without departing from the novel scope of the present invention. It will be understood by persons having skill in the art that monopole tower 10 may be of a type that acts merely as a structure to hold equipment or may be constructed of electrically conductive material and be used as a receiving and broadcasting antenna, without departing from the novel scope of the present invention.

Figure 2:
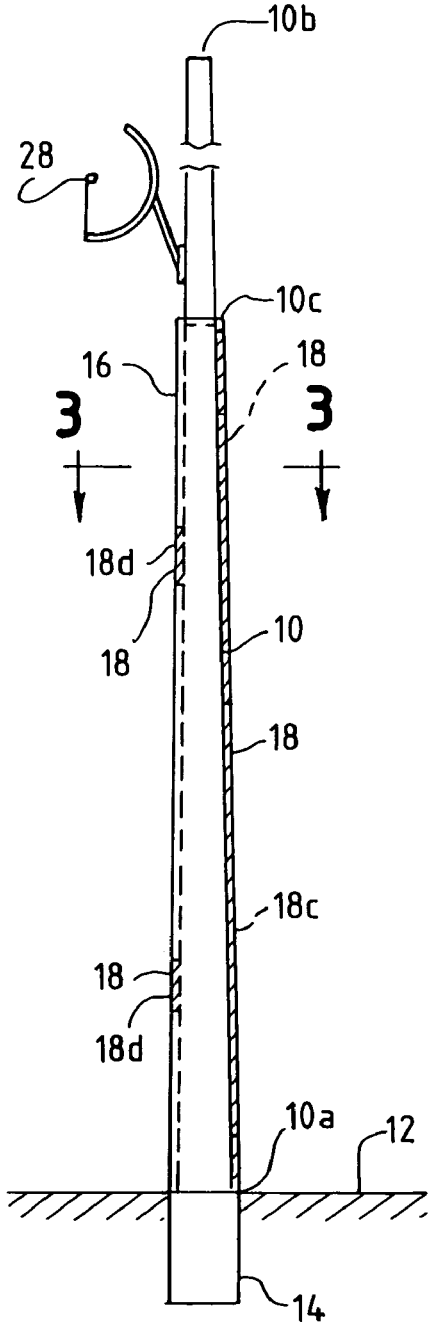
FIG. 2 is an elevational view of an antenna tower clad with an embodiment of the device of the present invention.

FIG. 2 shows the monopole tower 10 of FIG. 1 clad in a sheath or shell 16 from a point approximately at the base 10*a* of the tower 10 to a point 10*c* below the top 10*b* of tower 10. In a preferred embodiment of the present invention, sheath 16 is formed of a light-weight galvanized steel, which provides a protective covering to the monopole tower 10 without adding a lot of weight thereto. It will be understood by persons having skill in the art that sheath 16 may be made of any lightweight material having structural properties that may be used to stiffen the underlying monopole tower 10, without departing from the novel scope of the present invention. Such materials as aluminum, graphite, highbred materials, wood, plastics, ceramics and concrete may be used without departing from the novel scope of the present invention.

Further it will be understood that sheath 16 may be constructed such that it is a single unitary sheath or sheath 16 may be constructed such that it is a plurality of sheath segments which can be assembled, at the site of tower 10, into a unitary sheath. In a preferred embodiment, best illustrated in FIG. 4, sheath 16 is constructed of a plurality of shell plates 16*a* that are placed in an overlapping relationship 17. In this manner, the sheath 16 provides a stiffening element to itself, providing added strength to the tower-sheath combination.

Figure 3:
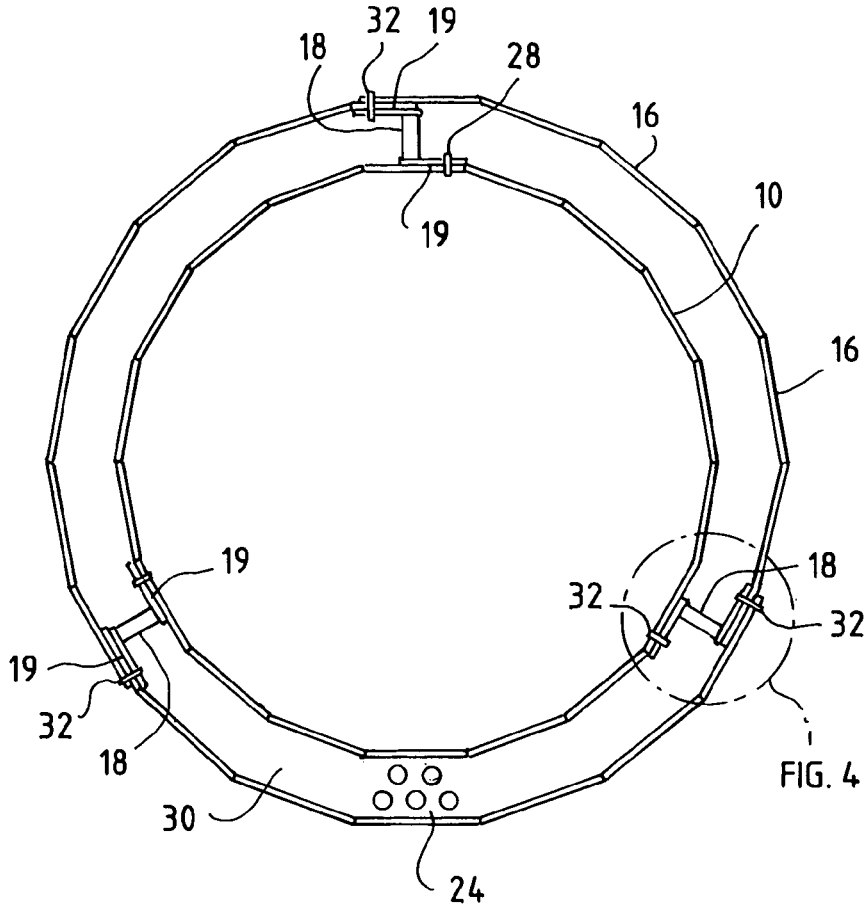
FIG. 3 is a cross-sectional view, taken along the plane of line 3—3 of FIG. 2.
Figure 4:
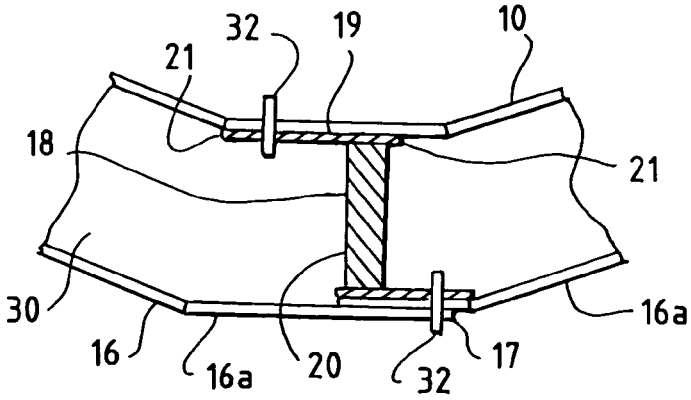
FIG. 4 is a detailed drawing of the area marked as "B" in FIG. 3.
Figure 5:
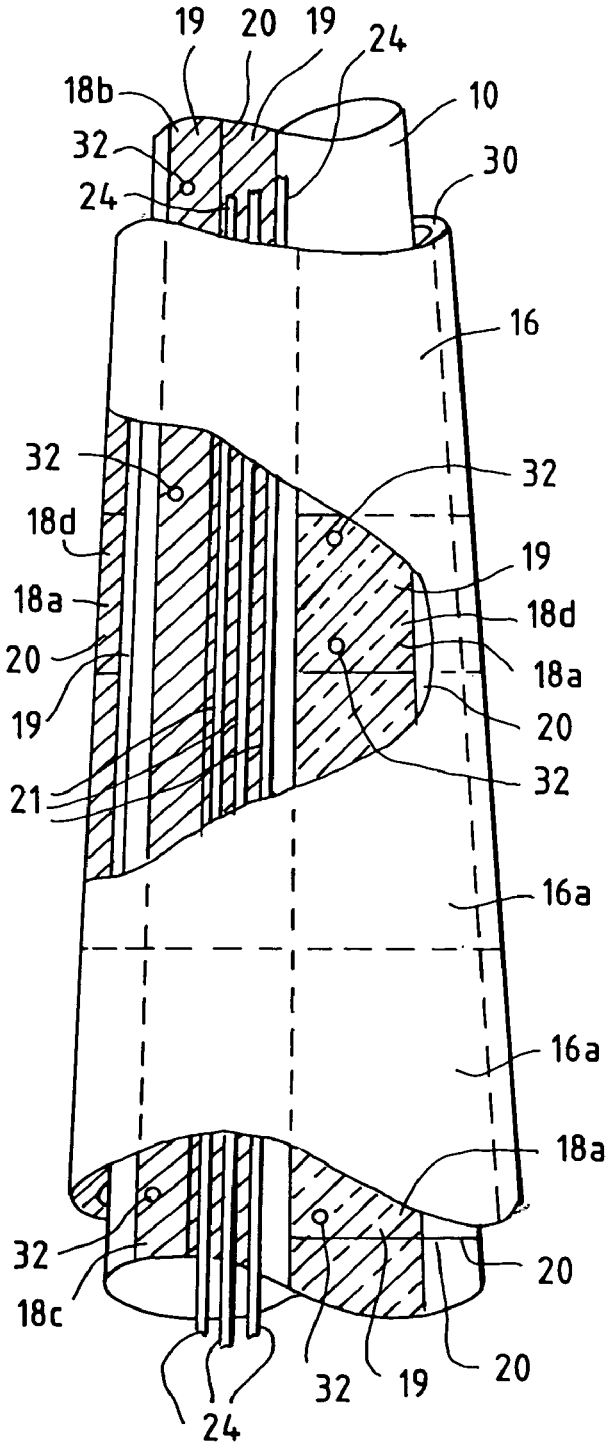
FIG. 5 is a partial perspective view, partially cut-away, of the tower and cladding of FIG. 2.

Referring now to FIGS. 3 and 4, a cross-section of the combined tower 10 and sheath 16 is shown. It will be seen that sheath 16 is set apart from tower 10 and three structural elements 18 are shown attached to both sheath 16 and tower 10. It will be understood by persons having skill in the art that elements 18, can be made to any desired length along the vertical axis, without departing from the novel scope of the present invention. As shown in FIG. 5, structural elements can run great lengths, such as element 18*b*, or can be of smaller lengths as element 18*a*, all without departing from the novel scope of the present invention.

FIG. 4 shows a detailed view of tower 10, sheath 16 and structural element 18. It will be seen that structural element 18, as illustrated, is a combined structural member, comprised of a series of plates attached together in a somewhat "Z" shaped form. It will be understood by persons having skill in the art that structural element 18 can be made of any structural shape and can be constructed either of a combination of elements or one cast, formed or rolled shaped form, including and I beam, H beam or other recognized structural form comprised of columns and flanges. Further, it will be understood by persons having skill in the art that structural element 18 may be constructed of any desirable material having such qualities as strength, durability, light weight and ease of attachment to a tower 10 and a sheath 16. Such structural elements as those made of hot or cold rolled steel, aluminum, graphite or highbred materials, as well as rubber, plastics, concrete and wood, can be used without departing from the novel scope of the present invention.

Referring again to FIG. 4, structural element 18 can be seen to be constructed of thin plates 19 and thicker plates 20. It will be understood that plates 19 and 20 can be assembled using techniques well known in the art. It will also be understood that while two plate 20 are shown, a single plate 20, or a plurality of plates 20, can be used without departing from the novel scope of the present invention. Typically, plates 19 and 20 will be welded together to form the desired shape (18) shown. Structural element 18 can then be attached, at one plate 19, to tower 10 and then sheath 16 can be attached to the other plate 19 to form the desired tower-sheath combination. Attachment may be made in any desired fashion, including the use of welds (both arc welds and spot welds), bolts, screws or other fasteners, and adhesives.

In a current embodiment, plates 19 are welded to the tower 10 as indicated at 21. The plates 19 can be attached to the sheath 16 using welds or self clamping bolts 18*a*. Alternately, powder actuated fasteners 32 may be used if acceptable under the appropriate structural codes, standards or specifications. In this manner the fastening may be done minimizing welding by using fastening elements 18 to secure the plates to the sheath 16. It will be understood by those skilled in the art that the technology of powder actuated fasteners may advance such that their use for securing the plates 19 to the tower 10 is acceptable under the appropriate codes, standards or specifications, and that use of these fasteners for securing the plates 19 to the tower 10 is within the scope and spirit of the present invention. It will also be understood, by persons having skill in the art, that in some instances a tower and sheath combination may be created as a unit and then placed in a desired location, such that the fastening of the elements together may be done in a safe environment, allowing the use of any type of fastener or fastening means.

In a preferred embodiment of the present invention the structural elements 18 are made of structural steel. In this preferred embodiment, two ¾ inch steel plates are welded together to form the fillet 18*a* of the structural element 18. The fillet 18*a* is then welded at each end 18*b* and 18*c*, to a ¼ inch steel end plate 18*d*, 18*e* to form a stylized "Z" shaped element wherein the fillet and end plates are perpendicular to each other. While the stylized "Z" shaped structural element 18 is shown and is a preferred embodiment, as described above, the use of other structural elements, having other shapes, can be used without departing from the novel scope of the present invention. While three such elements 18 are shown in FIG. 3 circumferentially spaced from one another, it will be understood that any number of structural elements 18 can be included without departing from the novel scope of the present invention.

In a current embodiment, the structural elements 18 extends a predetermined length (i.e., height along the tower 10), preferably extending upward from the base 10*a* in a contiguous manner, to a height as required by applicable codes, standards or specifications. It is contemplated that smaller length elements 18 may be used throughout the length of tower-sheath combination, that is from the base 10*a* to the top 10*c* (FIG. 2) of sheath 16. Such smaller length elements 18, if used, may be staggered, about the circumference of the tower, such that one element 18 is not directly above another along the length of antenna/sheath combination, or such that each such element is directly in line with the one above and below the element along the length of the tower, without departing from the novel scope of the present invention.

Referring again to FIG. 3, it will be seen that a space 30 is formed by the cladding of tower 10 with sheath 16. In a preferred embodiment of the present invention, space 30, which in combination with the length of sheath 16, forms a volume of space 22, can be utilized to house electrical cables 24. Such cables can be used to connect electrical communications devices such as satellite dishes 28 or other devices commonly used in modern communication. In this manner cables 24 are hidden from view from the outside of the tower 10, making for a more elegant and neat appearance.

Referring now to FIG. 5, a cut away section of the tower-sheath combination is shown. The structural element 18*c*, is formed from two plates 19, shown in a generally parallel orientation, with plates 20 attached to plates 19 and oriented generally perpendicular thereto. Shorter elements 18*d*, if used, can be formed as combinations of plates 19 and 20. Fastening members 32 are shown on all elements 18. Further, cables 24 are shown within space 30, between tower 10 and sheath 16. It will be seen that sheath 16 is formed of a plurality of plates 16*a*.

Figure 6:
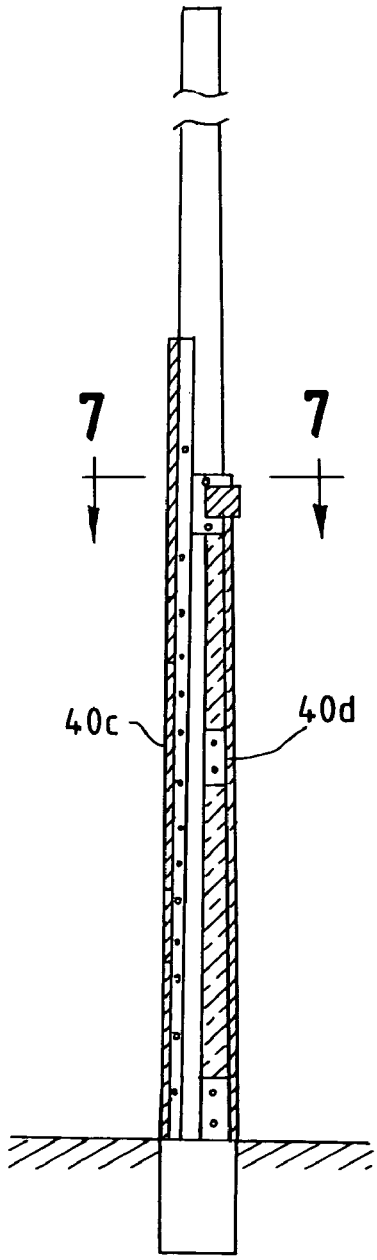
FIG. 6 is an elevational view of an antenna tower having another embodiment of the tower reinforcement of the present invention.

Referring now to FIG. 6, another embodiment of the present invention is shown. It will be seen that an antenna tower 10, of the type described above, can be fitted, in a manner as described above, with low-profile structural elements 40 in a manner similar to that described above, with the exception that a sheath, as discussed above is not attached. In a present embodiment, elements 40 extend along the length of the tower 10 from the base, upwardly, to a height as required applicable codes, standards or specifications.

Figure 7:
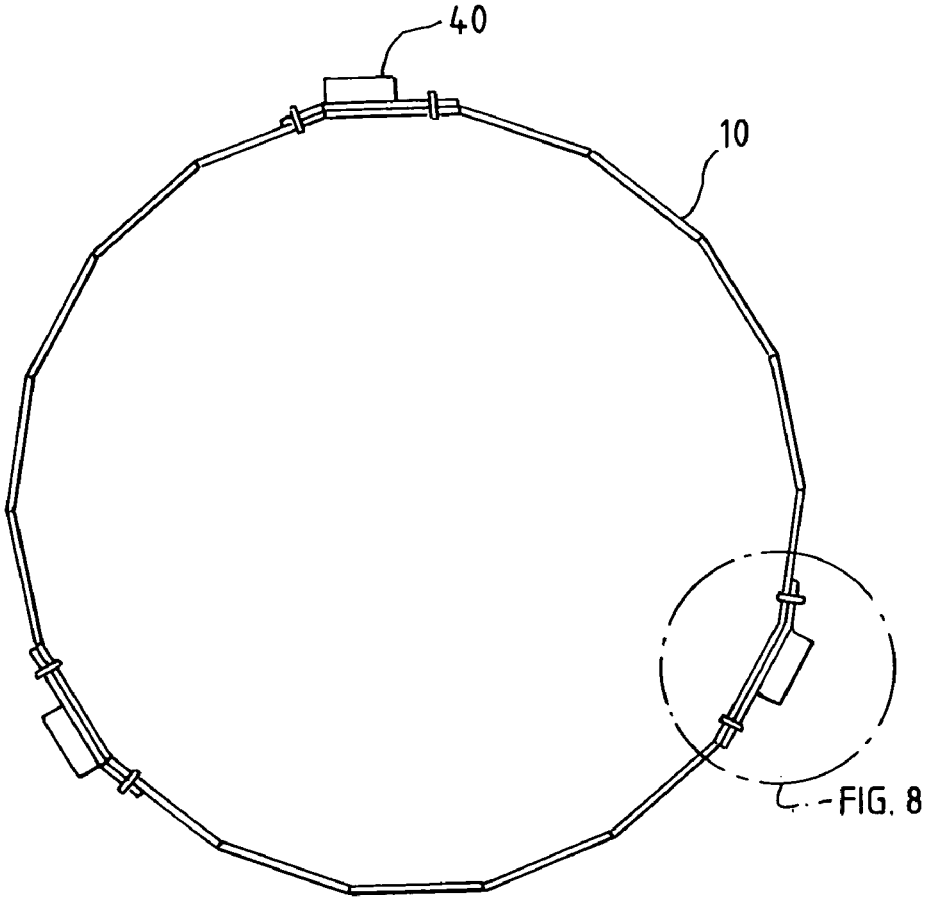
FIG. 7 is a cross-sectional view, taken along the plane of line 7—7 of FIG. 6.
Figure 8:
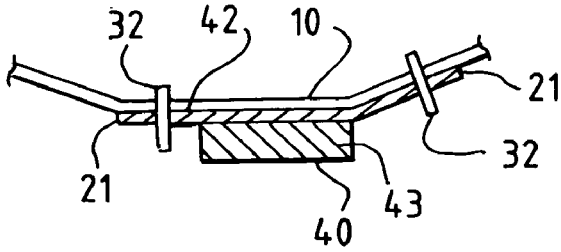
FIG. 8 is a detailed drawing of the area marked as "B" in FIG. 7.
Figure 9:
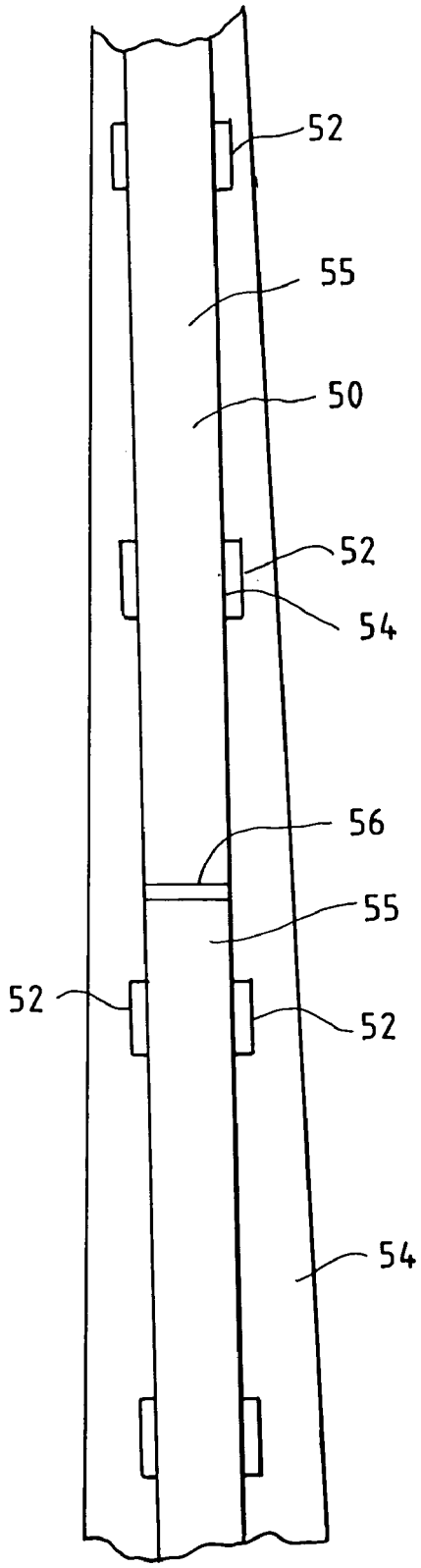
FIG. 9 is a front elevational view of a tower having a stiffening member and spacing elements.
Figure 10:
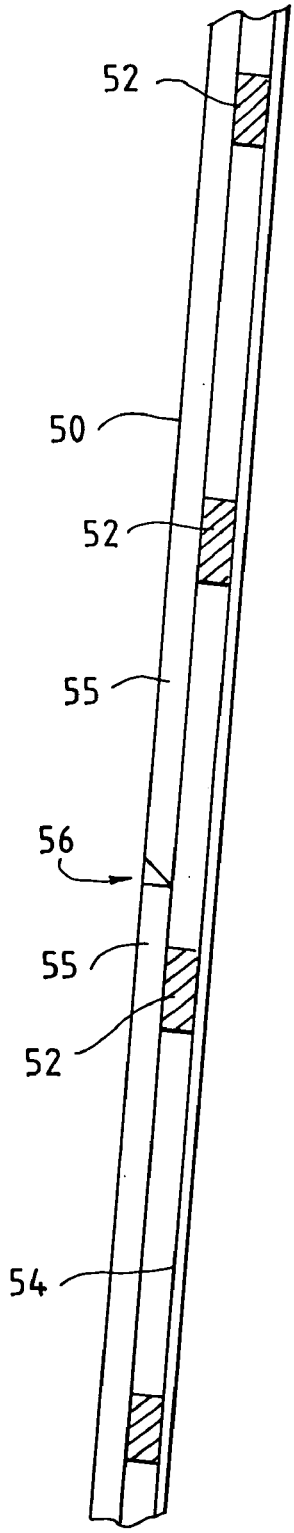
FIG. 10 is a side elevational view of the tower of FIG. 9.

Referring now to FIG. 7, a cross section of tower 10 and structural elements 40 is shown. Preferably in the present embodiment, elements 40 are spaced equally apart along the circumference of tower 10. It will be understood by persons having skill in the art that any spacing that provides an enhancement to the structural stability of tower 10 may be used without departing from the novel scope of the present invention. As more easily seen in FIG. 8, structural elements 40 can be constructed using techniques and elements similar to those described above, with respect to element 18. As illustrated, element 40 is comprised of a first plate 42 and a second plate 43. It will be seen that element 40 is made to have a lower profile than element 18, such that when placed on the surface of tower 10, structural element 40 will not be easily seen, giving the tower a graceful, uncluttered look while providing needed structural support. It will be understood by persons having skill in the art that any of the structural elements described above, and others, may be used me manner as described above.

In a present embodiment, the plates 42 are connected to the tower 10 by welding or self-clamping bolts. However, it is contemplated that powder actuated fasteners may be used to fasten plates 42 to tower 10. It will be understood by persons having skill in the art that other methods of fastening, particularly those described above, can be used to attach the structural elements 40 to tower 10 without departing from the novel scope of the present invention.

In a further embodiment of the present invention, elongated stiffening elements 50 are provided. Stiffening elements 50 can be made of any type of structural material, but preferably steel. Spacer elements 52 are provided to separate stiffening elements 50 from a tower 54. Tower 54 is of the type previously described. Spacer elements 52 are relatively small structural elements, having characteristics similar to those previously described for other structural elements. In a preferred embodiment a spacer 50 is a plate having dimensions of about 5 inches by 5 inches, in area, with a thickness of about ⅝ inches. It will be understood that spacers of different configurations, sizes and materials can be used without departing from the novel scope of the present invention. Typically a spacer 52 can be attached to the tower 54 in any manner previously described, or known, including using removable fasteners, rivets, adhesives, welds or combinations of these, such that the attachment is solid without causing damage to the tower. Spacers 52 can also be formed integrally with the tower 54 during its creation. In a preferred embodiment, spacers 52 are welded, about their entire perimeters, to tower 54, such that the spacers 52 are well joined to the tower 54 and are caused to behave as though they are constitutional elements of tower 54.

Elongated stiffening elements 50 can be attached to spacer elements 52 in any known manner, but preferably through welding. It will be understood by persons having skill in the art that the attachment of stiffening members 50 to spacers 52, connected to tower 54, provides a stiffening effect to tower 54.

In the creation of the reinforcement of the present embodiment of the present invention, a rectangular, or other shaped, spacer 52 is welded to the tower 54. The spacer 52 is a relatively small structural element, such as a plate, that can be placed at a desirable spacing, typically 3–5 feet on center. However, it will be understood that any spacing providing desirable structural support without interfering with the function of the tower can be made without departing from the novel scope of the present invention. In a preferred manner of attachment, a complete seal weld, between the tower 54 and spacer 52, is created around the entire perimeter of spacer 52.

Subsequent to the installation of the spacers 52, the main reinforcement stiffeners 50 are then placed over the spacer 52 and welded thereto. It will be understood by persons having skill in the art that other means and manner of attaching stiffeners 50 to spacers 52 can be used, such as attachment by fasteners or adhesives or the like, without departing from the novel scope of the present invention.

It will be seen that this method of attachment of stiffening elements to the tower 54 provides a number of advantages. First, it is more economical and less deleterious to the tower 54, to place a seal weld around a spacer 52 and the tower 54 than to continuously weld, along all edges, an elongated stiffening element 50 to the tower 54. Further, because the stiffening elements 50 are often constructed using a plurality of plates welded together, another advantage occurs at the points of joinder of these structural elements 55. As the stiffening elements 50 can be between 50 to 150 feet long, they are typically made by splicing one or more structural elements 55 together. Splicing is generally made by joining elements 55 together with a full penetration weld 56. This type of weld 56 can generate significant heat and therefore should not be made directly against the tower 54. Accordingly, by using the spacers 52, the main stiffeners 50 are spaced away from the tower 54 such that the splice welding can occur in such a manner that the excessive heat of a full penetration weld 56 is not transferred to the tower. Further, because the spacers 52 form a gap 58 between the stiffener 50 and tower 54, it is also possible to place some type of heat dissipating material between the tower 54 and the stiffening element 50 to further protect the tower 54 from the heat of the splice welding process.

Although illustrative embodiments of the invention have been shown and described, it is to be understood that various modifications and substitutions may be made by those skilled in the art without departing from the novel spirit and scope of the invention.

What is claimed is:

1. An antenna tower reinforcement, for use with an antenna tower, comprising:

a light-weight shell having a cross-scetional shape similar to that of an antenna tower and a diameter greater than the tower;

a plurality of spacers attached to the tower;

at least one stiffening members distributed between said shell and antenna tower and attached to at least two of the plurality of spacers;

the shell being attached to the at least one stiffening member and formed so as to have an outward appearance similar to that of the antenna tower such that when the tower and shell combination is viewed the tower and shell combination appears to be the tower alone.

2. The antenna tower reinforcement of claim 1, wherein the at least one stiffening members are structural steel members.

3. The antenna tower reinforcement of claim 1, wherein the at least one stiffening members are attached to the spacers by welding.

4. The antenna tower reinforcement of claim 1, wherein the light-weight shell is constructed of light gauge galvanized steel.

5. The antenna tower reinforcement of claim 1, wherein the light-weight shell extends from near a base of the antenna tower to a height less than the height of the antenna tower.

6. The antenna tower reinforcement of claim 5, wherein the attachment of the shell to the at least one stiffening member creates a volume between the shell and tower, extending from the base to the top of the shell, wherein cables may threaded.

7. The antenna tower reinforcement of claim 1, wherein the stiffening members are comprised of a plurality of structural steel shapes.

8. The antenna tower reinforcement of claim 7, wherein the structural steel shapes are steel plates welded together into a generally "Z" shaped member.

9. The antenna tower reinforcement of claim 1, including three stiffening members spaced equally apart on the circumference of the tower, each being attached to at least two of the plurality of spacers.

10. The antenna tower reinforcement of claim 1, wherein each stiffening members is approximately the length of the shell and when attached to the tower and shell is hidden by the shell.

11. An antenna tower reinforcement for use with a monopole antenna tower, the reinforcement comprising:

at least one stiffening member, the at least one stiffening member comprising first, second and third plate sections;

the first and second plate sections being generally parallel;

each of the first and second plate sections being joined to the third plate section so as to form the at least one stiffening member with a generally "Z" shaped cross-section;

the at least one stiffening member attached to the antenna tower such that the stiffening member reinforces the tower.

12. The antenna tower reinforcement of claim 11, further comprising:

a plurality of spacer elements;

the plurality of spacer elements attached to the antenna tower;

the first plate section of the at least one stiffening member attached to the plurality of spacer elements.

13. The antenna tower reinforcement of claim 11, further comprising:

a shell;

the shell attached to the second plate section of the at least one stiffening member;

the shell having a cross-sectional shape similar to that of the antenna tower and having a larger cross-section than the antenna tower at any height of the shell.

14. An antenna tower reinforcement for use with a monopole antenna tower, the reinforcement comprising:

at least one stiffening member;

a shell;

the at least one stiffening member attached to the antenna tower such that the stiffening member reinforces the tower;

the shell attached to the at least one stiffening member;

the shell having a cross-sectional shape similar to that of the antenna tower and having a larger cross-section than the antenna tower at any height of the shell, wherein the at least one stiffening member comprises first, second and third plate sections, the first and second plate sections being generally parallel, and each of the first and second plate sections being joined to the third plate section so as to form the at least one stiffening member with a generally "Z" shaped cross-section.

15. The antenna tower reinforcement of claim 14, further comprising:

a plurality of spacer elements;

the plurality of spacer elements attached to the antenna tower;

the at least one stiffening member attached to the plurality of spacer elements.

* * * * *